US005749668A

United States Patent [19]

McIlvain et al.

[11] Patent Number: 5,749,668

[45] Date of Patent: May 12, 1998

[54] APPARATUS FOR EXERCISING AND/OR REHABILITATING AN ANKLE

[76] Inventors: Gary Eugene McIlvain, 4423 Soper Ave., Nashville, Tenn. 37204; Charles Neil McIlvain, 5625 Constantine Dr., Rockvale, Tenn. 37153

[21] Appl. No.: 703,352

[22] Filed: Aug. 21, 1996

[51] Int. Cl.[6] ..... A63B 23/08

[52] U.S. Cl. ..... 482/79; 482/99; 601/27

[58] Field of Search ..... 482/79, 80, 93, 482/94, 98, 99, 100; 601/23, 27, 29

[56] References Cited

U.S. PATENT DOCUMENTS

| | | |
|---|---|---|
| 4,691,694 | 9/1987 | Boyd et al. . |
| 5,209,223 | 5/1993 | McGorry et al. . |
| 5,211,161 | 5/1993 | Stef . |

OTHER PUBLICATIONS

Product Brochure—Chattanooga Group, Inc., Kin-Com System, 1995.

Catalog—Flaghouse Rehab, Spring 1995, p. 36—Ankle/Leg Exerciser.

*Primary Examiner*—Lynne A. Reichard

*Attorney, Agent, or Firm*—Waddey & Patterson; Laura K. Thomas

[57] ABSTRACT

An apparatus for exercising the ankle, comprising a base frame, a seat support section attached to the base frame, and a seat adjustably mounted to the seat support section. The apparatus includes a foot carriage assembly comprising a foot carriage frame pivotally attached to the base frame for enabling plantar and dorsiflexion of the foot, a support arm pivotally attached to the foot carriage frame for enabling inversion and eversion of the foot, and a foot platform pivotally attached to the support arm for enabling abduction and adduction of the foot. A resistance system is operably connected to the foot carriage assembly for providing resistance against a force applied by a patient during use. The resistance system further comprises at least one weight stack, including a longitudinal weight rest and at least one guide rod attached to the base frame and extending through the longitudinal weight rest to enable the weight stack to maintain a vertical alignment with the base frame during use, and a complex pulley system operably attached to the foot carriage assembly for enabling the at least one weight stack to be raised and lowered in response to movement of the foot carriage assembly. The pulley system further comprises an abduction/adduction pulley system, a plantar/dorsiflexion pulley system, and an inversion/eversion pulley system.

31 Claims, 9 Drawing Sheets

APPARATUS FOR EXERCISING AND/OR REHABILITATING AN ANKLE

BACKGROUND OF THE INVENTION

1. Field of the Invention

The present invention relates generally to exercise devices or apparatuses, and more particularly to such devices or apparatuses for exercising and/or rehabilitating the lower leg and ankle of a human being.

2. Description of the Related Art

Effective and complete strengthening and/or post-injury rehabilitation of the ankle requires that the lower leg be isolated to enable movement of the ankle throughout the entire range of motion in inversion (turning the sole of the foot toward a midline of the body), eversion (turning the sole away from the midline), dorsi flexion (moving the top of the foot upward, i.e., standing on the heels), plantar flexion (moving the sole of the foot downward, i.e. standing on the toes), abduction (outward lateral movement of the foot away from the midline) and adduction (inward lateral movement of the foot toward the midline).

There are several commercially available apparatuses that are used in strengthening and/or rehabilitating the ankle. Accordingly, the art to which the present invention relates includes a device manufactured by the Elgin Corporation and sold under the trade designation Elgin Ankle Exerciser. The device comprises a platform pivotally mounted to a base. The platform is configured to receive the foot, and weights may be added to the front, back and sides of the platform to increase resistances.

An isokinetic device sold by the Chattanooga Group, Inc., under the trade designation KIN-COM, comprises an adjustable patient chair and a plurality of fixtures attachable to a structure for exercising and/or rehabilitating the patient seated in the chair. The device includes a computer terminal operably attached to a plurality of sensors mounted to the device enabling the device to be programmed to exercise the patient within certain predetermined limits.

U.S. Pat. No. 4,691,694, granted to Boyd et al. and incorporated by reference as if fully set forth herein, is directed to a muscle exercise and rehabilitation apparatus sold by Biodex Corporation, under the trade designation BIODEX. The isokinetic apparatus includes a movable fixture against which a force can be applied, a servo motor having an output shaft coupled to the fixture; a strain gauge effectively coupled between the output shaft and the fixture for producing a load signal corresponding to the force applied to the fixture; a speed detector for producing a velocity signal corresponding to the speed of the fixture; a closed loop servo circuit for controlling the motor in response to the load and velocity signals to regulate the velocity of the fixture; a limit circuit for preventing movement of the fixture past opposite limits, a storage circuit for storing limit signals corresponding to each limit; a limit setting circuit for enabling the storage circuit to store each limit upon movement of the fixture thereto; a position sensing circuit for producing a position signal corresponding to the position of the fixture; a deceleration circuit for slowing down movement of the fixture as the fixture approaches the limit, in response to the velocity, position and limit signals; detecting circuits for detecting a plurality of predetermined operational faults of the apparatus; an emergency stop circuit for terminating operation of the apparatus upon detection of some of the operation faults; a dynamic brake for braking the servo motor to stop movement of the fixture in response to the emergency stop circuit; and a stop circuit for controlling the motor to stop movement of the fixture upon detection of other operation faults.

U.S. Pat. No. 5,209,223, granted to McGorry et al. and incorporated by reference as if fully set forth herein, is directed to a single chair muscle exercise and rehabilitation apparatus sold by Biodex Medical Systems, Inc., under the trade designation BIODEX. The apparatus includes a patient chair having a first side and a second side. Structure is provided for the rehabilitation and exercise of a patient seated in the patient chair. Structure is provided to move the rehabilitation and exercise structure between a first position adjacent the first side of the patient chair and a second position adjacent the second side of the patient chair in a first linear path. Structure is provided to support the patient chair for movement along a second linear path toward and away from the exercise and rehabilitation structure.

U.S. Pat. No. 5,211,161, granted to Stef and incorporated by reference as if fully set forth herein, is directed to a three axis passive motion exerciser. The device moves a patient's foot in dorsal/plantar, valgus/varus and abduction/adduction movements. A microprocessor provides signals to control motors which drive cradles and a plate in the desired motions. Potentiometers provide positional feedback information about the actual location of the cradles and the plate, with series resistors providing feedback of the actual motor drive current values. The microprocessor monitors the positions of two motions versus a master motion to keep the movements in synchronization. The movements are synchronized so that the end of the travel limit is reached for each axis simultaneously. The microprocessor further monitors the drive currents to prevent overcurrent conditions and the speeds to limit travel rates. A display and keyboard are provided to allow the operator to monitor and change operating parameters, such as travel limits, force limits and session times.

Many of these devices are not designed to specifically work the ankle. Accordingly, these devices must be modified with attachments to accommodate the ankle, and it is believed that they do not properly isolate the movement to the lower leg to provide complete rehabilitation. Moreover, many of the devices are limited in that they are not capable of exercising or rehabilitating the ankle in the six anatomical directions. For example, the KIN-COM device requires special attachments for abduction/adduction and plantar/dorsiflexion of the ankle.

Another drawback associated with many of the commercially available devices is that the pivot point of the device is positioned below the base and, thus, below the actual pivot of the ankle, preventing isolation of the movement of the lower leg and resulting in improper mechanics during exercise and/or rehabilitation.

The normal anatomical limits of the ankle in terms of angular movement from the neutral position are five degrees each for inversion and eversion, twenty degrees for dorsi flexion, fifty degrees for plantar flexion, ten degrees for abduction and twenty degrees for adduction. Many of the commercially available devices do not provide means for automatically returning the ankle toward the neutral position when force is no longer exerted during exercise.

Until now, it is believed that an ankle exerciser/rehabilitation apparatus capable of properly isolating the lower leg and exercising or rehabilitating the ankle in all six anatomical positions has not been invented.

SUMMARY OF THE INVENTION

The present invention is designed to overcome the limitations of currently available commercial devices and to provide an apparatus which enables the patient to assume an anatomically neutral position during the exercising of the ankle in six directions of movement. The apparatus is preferably constructed of tubular steel, however, other suitable materials, such as aluminum, are contemplated to be within the scope of the present invention. The apparatus comprises a primary base frame including a horizontal section and a vertical section. A seat assembly support section is mounted to the base frame. In the preferred embodiment, the base frame includes casters or wheels for mobilizing the apparatus. Leveling devices are provided at the corners of the base frame to stabilize the apparatus. Each leveling device comprises a threaded rod having one end received within a bore in the base frame and an opposite end attached to a foot enabling the device to be raised off of the casters and supported on the foot.

The seat assembly support section further includes a seat carriage comprising a pair of crossmembers attached perpendicularly to a pair of spaced apart side members to form a seat carriage frame. A seat, which may be adjusted forward, backward, up, down, or from side to side, is mounted on a pedestal extending upwardly from the seat carriage frame. Accordingly, a side roller assembly attached to the side members enables forward and backward adjustment of the seat. The crossmembers of the seat carriage are received within a pair of sleeves attached to a seat pedestal base enabling side to side adjustment of the seat. The seat includes a seatbelt and straps for securing the leg in order to isolate movement to the ankle area.

In the preferred embodiment, adjustment of the seat is achieved by motorized linear actuator means electrically controlled by a remote control unit configured to trigger the motorized actuator means. However, a manually adjustable seat is also contemplated to be within the scope of the present invention. The proper seat position for a particular patient may be determined by referring to indicators mounted along the front and side of the seat assembly support section and an indicator mounted vertically at the back of the seat.

The apparatus further includes a plurality of weight slides or weight stacks, each comprising a longitudinal weight rest, at least one guide rod rigidly attached to the base frame, and a cable attached to the weight rest. The weight rest is vertically slidable along the at least one guide rod enabling the weight stack to maintain vertical alignment with the base frame during use. The at least one guide rod includes a series of bores configured to receive pins for adjusting the vertical travel of the weight rest. A plurality of weights may be placed on the longitudinal weight rest to achieve the desired amount of resistance. Retaining chains may be provided to maintain the foot carriage frame in a neutral position by removing the resistance associated with the weight slides.

A foot carriage assembly includes a foot carriage frame and a foot plate assembly. The foot carriage frame is pivotally attached to the base frame at its sides to enable upward and downward pivotal movement (plantar/dorsiflexion) of the foot carriage frame. Counterweights are mounted on the foot carriage frame to maintain the foot carriage frame in a neutral position wherein the frame is parallel to a horizontal plane. A locking device comprising a bracket configured to receive a front edge of the foot carriage frame is pivotally mounted to the base frame. Accordingly, the locking device may be pivoted to receive the front edge of the foot carriage frame to prevent upward and downward pivotal movement of the foot carriage frame.

The foot plate assembly includes a foot platform pivotally mounted on a U-shaped support arm. The support arm is pivotally attached at its ends to the foot carriage frame to enable side to side pivotal movement of the foot plate assembly. Adjustable heel and side brackets are provided to accommodate various foot sizes. Also, straps may be provided to secure to foot to the foot platform during exercise. A locking device comprising a locking rod, a clamp and a locking screw is provided to prevent movement of the foot plate assembly. One end of the locking rod is attached to the support arm, and an opposite end is received within the clamp. The locking screw extends into a bore in the clamp and may be tightened against the rod to prevent movement thereof.

The platform includes an arcuate front edge received within an L-shaped flange extending from a top surface of the support arm. One end of the shaft of a pulley wheel is operably attached to a bottom surface of the rear portion of the foot platform enabling the foot platform to be pivoted laterally through an arc. A locking screw or bolt extends through a bore in the support arm and the platform to frictionally engage an inner surface of the flange. Accordingly, the screw may be tightened to prevent pivotal movement of the foot platform.

The apparatus includes a plurality of gauges mounted at appropriate locations to measure angular displacement during abduction/adduction, inversion/eversion and plantar/dorsiflexion. The apparatus further includes a plurality of electronic pressure sensors for measuring the amount of resistance applied during isometric exercises (i.e., muscle contraction with no joint movement).

A foot carriage pulley system comprising a pulley wheel mounted on a central shaft (described hereinabove) enables the patient to achieve abduction and adduction of the ankle. A cable slidably engages the pulley wheel and first and second pairs of intermediate pulley wheels mounted to the base frame. Each of the ends of the cable are attached to a longitudinal rest of a weight slide. Accordingly, the weight slides move up and down oppositely in response to rotation of the foot on the foot platform.

A side pulley system comprising a pair of primary pulley wheels, a pair of intermediate pulleys, and a pair of cables enables the patient to achieve plantar and dorsiflexion of the ankle. A primary pulley is pivotally mounted to each side of the foot carriage frame. One of the cables is attached at one end to one of the primary pulleys and to a weight slide at the opposite end. The other cable is similarly attached to the other primary pulley wheel and another weight slide. Each of the cables slidably engages a pair of the intermediate pulleys mounted to the base frame. Accordingly, the longitudinal weight rests move up and down oppositely in response to upward and downward movement (plantar/dorsiflexion) of the foot on the foot platform.

A lateral pulley system comprising a pair of pulley wheels and a pair of cables is provided to enable inversion and eversion of the foot. A pulley wheel is mounted at each side of the horizontal section of the base frame. One of the cables is attached at one end to the support arm and to a weight slide at the opposite end. The other cable is similarly attached to the other pulley wheel and another weight slide. As the foot is pivoted from side to side, the cables slidably engage the pulley wheels and the weight slides move up and down oppositely in response to the movement of the foot.

The present invention may, therefore, be summarized in a variety of ways, one of which is the following: an apparatus for exercising an ankle, comprising a base frame; a seat mounted on the base frame; a foot carriage assembly comprising a foot carriage frame pivotally attached at spaced apart sides to the base frame enabling plantar and dorsiflexion of the foot; the foot carriage frame further including a foot plate assembly comprising a support arm pivotally attached at spaced apart ends to the foot carriage frame such that the support arm pivots about a longitudinal axis of the apparatus enabling inversion and eversion of the foot, and a foot platform pivotally attached to the support arm such that the platform pivots laterally about a pivot point at a rear portion of the platform enabling abduction and adduction of the foot; and a resistance system operably connected to the foot carriage assembly for providing resistance against a force applied by a patient during use.

The resistance system comprises at least one weight stack including a longitudinal weight rest for supporting at least one weight, at least one guide rod attached to the base frame and extending through the longitudinal weight rest to enable the weight stack to maintain vertical alignment with the base frame during use; and a pulley system operably attached to the foot carriage assembly and the at least one weight stack to enable the at least one weight stack to be raised and lowered in response to movement of the foot carriage assembly. The at least one guide rod further comprises a pin mechanism for adjusting the vertical travel of the longitudinal weight, rest.

The pulley system further comprises an abduction/adduction pulley system including a primary pulley wheel having a central shaft extending through the support arm and operably attached to the foot platform, first and second pairs of intermediate pulleys mounted to the base frame, and a cable in operable communication with the primary pulley wheel, the first and second pairs of intermediate pulleys and having free ends, each end being attached to a weight stack. The pulley system also includes a plantar/dorsiflexion pulley system including a pair of primary pulley wheels, each having a central shaft operably attached to the foot carriage frame, a pair of intermediate pulleys mounted to the base frame, and a pair of cables, each cable having one end in operable communication with one of the primary wheels and one of the intermediate pulley wheels and having an opposite end attached to a weight stack. The pulley system further includes an inversion/eversion pulley system including a pair of pulley wheels mounted to the base frame, and a pair of cables, each cable having one end attached to the support arm and an opposite end attached to a weight stack.

The foot platform further comprises an arcuate heel bracket; and adjustable side brackets for constraining the foot of a patient to the foot platform during use.

The apparatus comprises a locking device for restricting movement of the foot carriage frame, the support arm and the foot platform. The apparatus further includes a seatbelt for securing a patient to the seat, and leg straps attached to the seat for restricting movement to the lower leg of the patient.

The apparatus further comprises at least one pitch angle gauge operably mounted to the apparatus for measuring an angular displacement of the foot carriage assembly during exercise of the patient's foot, and at least one pressure sensor operably mounted to the apparatus for enabling the amount of force applied by the patient during exercise of the foot in a direction to be measured.

The apparatus further comprises a seat carriage assembly including a pair of side members perpendicularly attached to crossmembers to form a seat carriage frame, the seat carriage frame further including a side roller assembly for enabling the forward and backward adjustment of the seat and a pair of sleeves configured to slidably receive the crossmembers for enabling the side to side adjustment of the seat. The seat is pivotally mounted to the seat carriage assembly.

The apparatus further includes at least one linear actuator operably linked to at least one motor and to the seat for adjusting the position of the seat.

Yet another way of summarizing the present invention is as follows: an apparatus for exercising an ankle, comprising a base frame; a seat support section extending from the base frame; a seat attached to the seat support section, at least one weight slide including a longitudinal weight rest for supporting at least one weight and a cable attachment rod; a foot carriage assembly comprising a foot carriage frame pivotally attached at spaced apart sides to the base frame, the foot carriage frame further including a foot plate assembly comprising a foot platform having brackets to constrain movement of the foot, wherein the platform is pivotally attached to the foot carriage frame via a support arm; and a complex pulley system in communication with and operably attached to the foot carriage assembly to enable the at least one weight slide to be raised and lowered in response to movement of the foot carriage assembly in any user selected direction. The base frame further comprises a horizontal section and a vertical section. The upright seat support section further comprises a seat carriage comprising a pair of side members perpendicularly attached to adjoining crossmembers. The apparatus includes casters and leveling feet mounted to the base frame.

The complex pulley system further comprises an abduction/adduction pulley system, a plantar/dorsiflexion pulley system and an inversion/eversion pulley system. The abduction/adduction pulley system includes a primary pulley wheel having a central shaft extending through the support arm and operably attached to the foot platform, first and second pairs of intermediate pulleys mounted to the base frame, and a cable in operable communication with the primary pulley wheel, the first and second pairs of intermediate pulleys and having free ends, each end being attached to a weight slide. The plantar/dorsiflexion pulley system includes a pair of primary pulley wheels, each having a central shaft operably attached to the foot carriage frame, a pair of intermediate pulleys mounted to the base frame, and a pair of cables, each cable having one end in operable communication with one of the primary wheels and one of the intermediate pulley wheels and having an opposite end attached to a weight slide. The inversion/eversion pulley system includes a pair of pulley wheels mounted to the base frame, and a pair of cables, each cable having one end attached to the support arm and an opposite end attached to a weight slide.

The apparatus further comprises motorized linear actuator means for adjusting the position of the seat. The motorized actuator means is electrically controlled by a central control box which actuates the motorized linear actuator means. The apparatus further includes a remote control unit configured to trigger the control box into actuating the motorized linear actuator means.

The apparatus further comprises a position indicator mounted to the apparatus displaying a user selected seat position.

A third way of summarizing the present invention is: an apparatus for exercising the ankle and lower leg, comprising a base frame; a seat assembly support section attached to the base frame, the seat assembly support section further including a seat attached to a seat carriage; motorized actuator means for adjusting the position of the seat, wherein the actuator means is electrically controlled by a remote control unit configured to trigger the actuator means, a foot carriage assembly including a foot carriage frame pivotally attached at spaced apart sides to the base frame for enabling plantar and dorsiflexion of the foot, and a foot plate assembly, the foot plate assembly further including a support arm pivotally attached at spaced apart ends to crossmembers of the foot carriage frame for enabling inversion and eversion of the foot, and a foot platform pivotally attached to the support arm for enabling abduction and adduction of the foot, the foot platform further comprising a heel bracket and adjustable side brackets for constraining the patient's foot; a weight resistance system for providing resistance to a force applied to the foot carriage assembly during exercise of the foot; and a pulley system operably attached to the weight resistance system and the foot carriage assembly for transmitting the opposing force from the weight resistance system to the foot carriage assembly.

The seat carriage further comprises a pair of spaced apart side members attached to crossmembers to form a seat frame component; a side roller assembly including rollers operably mounted to the side members and positioned to slidably engage the base frame; a pair of sleeves configured to receive the crossmembers; and a seat pedestal mounted to the seat frame component.

The weight resistance system further comprises at least one weight slide including a longitudinal weight rest configured to slidably engage at least one guide rod mounted to the base frame enabling the weight slide to maintain vertical alignment with the base frame during use.

The pulley system further comprises a foot plate pulley system for enabling abduction and adduction of the foot, the foot plate pulley system including a primary pulley wheel having a central shaft extending through the support arm and operably attached to the foot platform, first and second pairs of intermediate pulleys mounted to the base frame, and a cable in operable communication with the primary pulley wheel, the first and second pairs of intermediate pulleys and having free ends, each end being attached to a weight stack; a side pulley system for enabling plantar and dorsiflexion of the foot, the side pulley system including a pair of primary pulley wheels, each having a central shaft operably attached to the foot carriage frame, a pair of intermediate pulleys mounted to the base frame, and a pair of cables, each cable having one end in operable communication with one of the primary wheels and one of the intermediate pulley wheels and having an opposite end attached to a weight stack; and a lateral pulley system for enabling inversion and eversion of the foot, the lateral pulley system including a pair of pulley wheels mounted to the base frame, and a pair of cables, each cable having one end attached to the support arm and an opposite end attached to a weight stack.

It is an object of the present invention to provide an apparatus for exercising the ankle in six anatomical directions, namely abduction, adduction, plantar, dorsiflexion, inversion and eversion.

It is an object of the present invention to provide an apparatus for exercising the ankle in which the patient is positioned on the apparatus in an anatomically neutral position.

It is an object of the present invention to provide an apparatus for exercising or rehabilitating the ankle comprising a base frame, a seat assembly support section, a seat carriage, a foot carriage assembly, and a plurality of weight slides attached to the foot carriage assembly by a plurality of cables.

It is an object of the present invention to provide an apparatus for exercising or rehabilitating an ankle including a foot carriage pulley system for achieving abduction/adduction, a side pulley system for achieving plantar/dorsiflexion, and a lateral pulley system for achieving inversion/eversion of the ankle.

It is an object of the present invention to provide an apparatus for exercising the ankle having a plurality of gauges for measuring the angular displacement of the ankle during abduction/adduction, plantar/dorsiflexion, and inversion/eversion.

It is an object of the present invention to provide an apparatus for exercising and/or rehabilitating the ankle wherein movement is isolated to the lower leg and ankle.

It is an object of the present invention to provide an apparatus for exercising and/or rehabilitating the ankle wherein the pivot point of the apparatus is aligned with the actual pivot point of the foot at the ankle.

It is an object of the present invention to provide an apparatus having an adjustable seat capable of being positioned at the exact same location for each patient for each separate use of the apparatus.

These and other objects, features and advantages shall become apparent after consideration of the description and drawings set forth herein. All such objects, features and advantages are contemplated to be within the scope of the present invention even though not specifically set forth herein.

DETAILED DESCRIPTION OF THE PREFERRED EMBODIMENT

Figure 1:
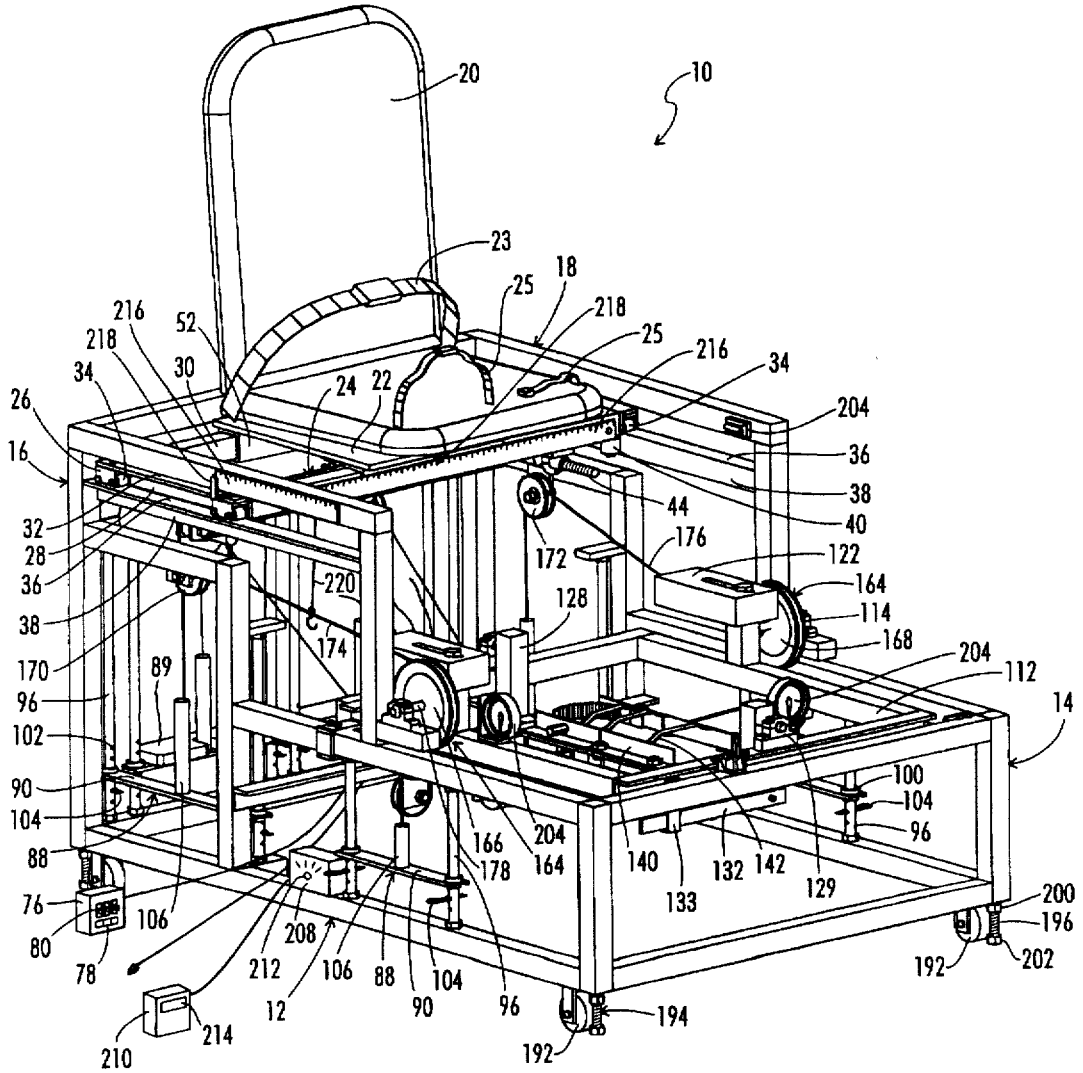
FIG. 1 is an elevated perspective view of the ankle exerciser of the present invention.
Figure 2:
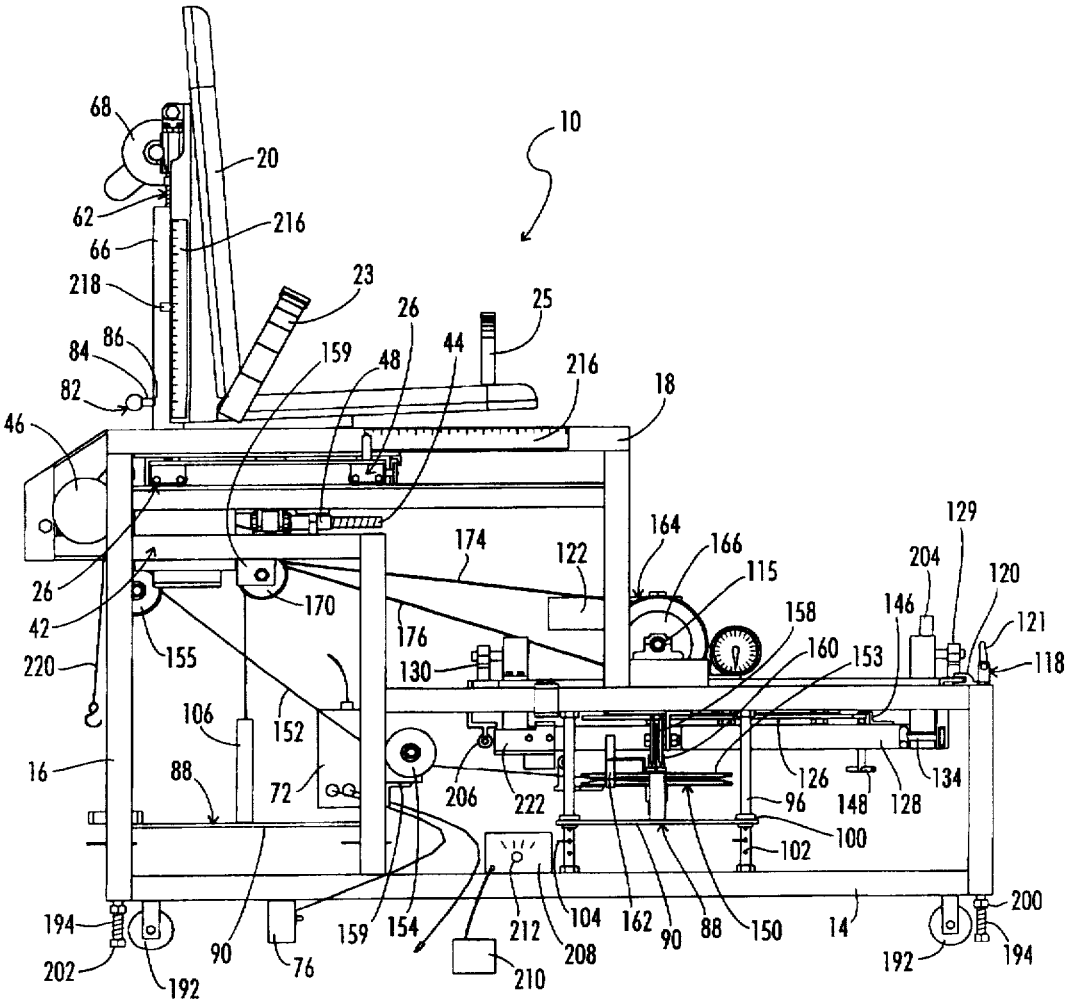
FIG. 2 is a side elevational view of the embodiment of the invention shown in FIG. 1.

With reference to FIGS. 1 and 2, a preferred embodiment of the present invention is designated generally by the reference numeral 10. Preferred embodiment 10 comprises a primary base frame 12 including a horizontal section 14 and a vertical section 16. A seat assembly support section 18 is rigidly mounted to the base frame 12.

The seat assembly support section 18 comprises a seat 20 mounted on a pedestal 21 extending upwardly from a pedestal base plate 22 mounted to a seat carriage 24. In the preferred embodiment, the seat 20 includes a seat belt 23 and straps 25 for securing the leg in order to isolate movement to the ankle during exercise. The seat carriage 24 includes a side roller assembly 26 comprising a pair of spaced apart L-shaped side members 28, each of which is perpendicularly attached at its ends to spaced apart horizontal crossmembers 30 to form a substantially rectangular frame component. One leg of each of the side members 28 extends outwardly forming a flange 32 to which rollers 34 are mounted. Rollers 34 slidably engage a top surface 36 of an L-shaped side member 38 of the seat assembly support section 18 enabling forward and backward adjustment of the seat 20. Guide rollers 40 are mounted at the ends of the crossmembers 30 and positioned to slidably engage an inner side surface of the side member 38 of the seat assembly support section 18.

Figure 4:
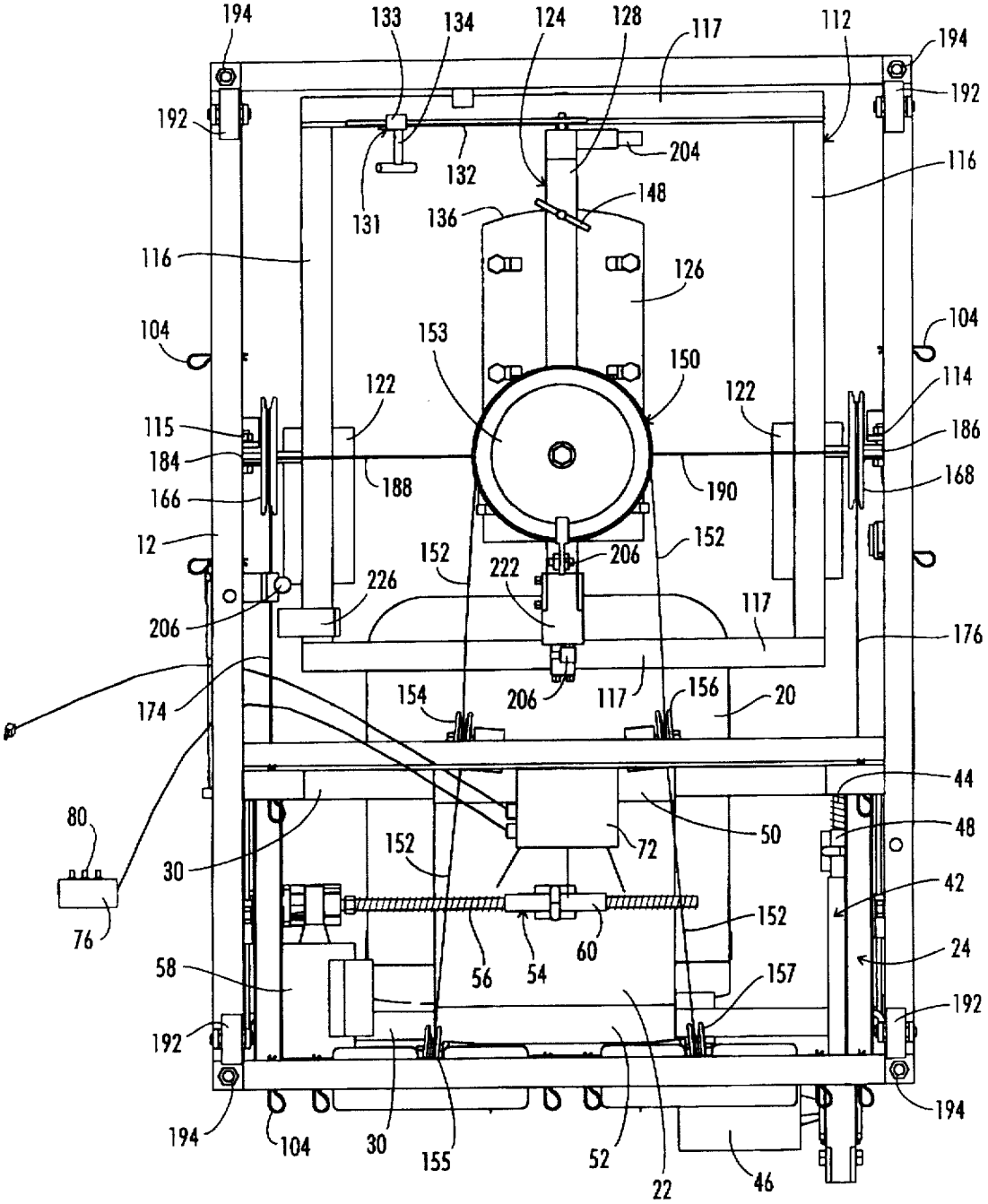
FIG. 4 is a bottom view of the embodiment of the invention shown in FIG. 1.

In the preferred embodiment, the seat may be adjusted up and down, forward and backward and from side to side by motorized linear actuator means. With reference to FIGS. 2 and 4, a first linear actuator 42 comprising a threaded shaft 44, operably attached to a first motor 46, is mounted to the vertical section 16 of the base frame 12 such that the longitudinal axis of the threaded shaft 44 is parallel to the longitudinal axis of the base frame 12. A threaded nut 48, which is mounted to the seat carriage 24, threadably engages the threaded shaft 44 of the linear actuator 42 to move the seat 20 forward and backward in response to rotation of the shaft 44.

With reference to FIGS. 1 and 4, the pedestal base plate 22 is rigidly attached to a pair of sleeves 50 and 52. Each sleeve includes a hollow interior configured to slidably receive the crossmembers 30 of the seat carriage 24 enabling side to side adjustment of the seat. A second linear actuator 54 comprising a threaded shaft 56, operably attached to a second motor 58, is mounted to the vertical section 16 of the base frame 12 (see FIGS. 3 &4). A threaded nut 60, which is mounted to the pedestal base plate 22, threadably engages the threaded shaft 56 of the second linear actuator 54 to move the seat 20 from side to side in response to rotation of the shaft 56.

Figure 3:
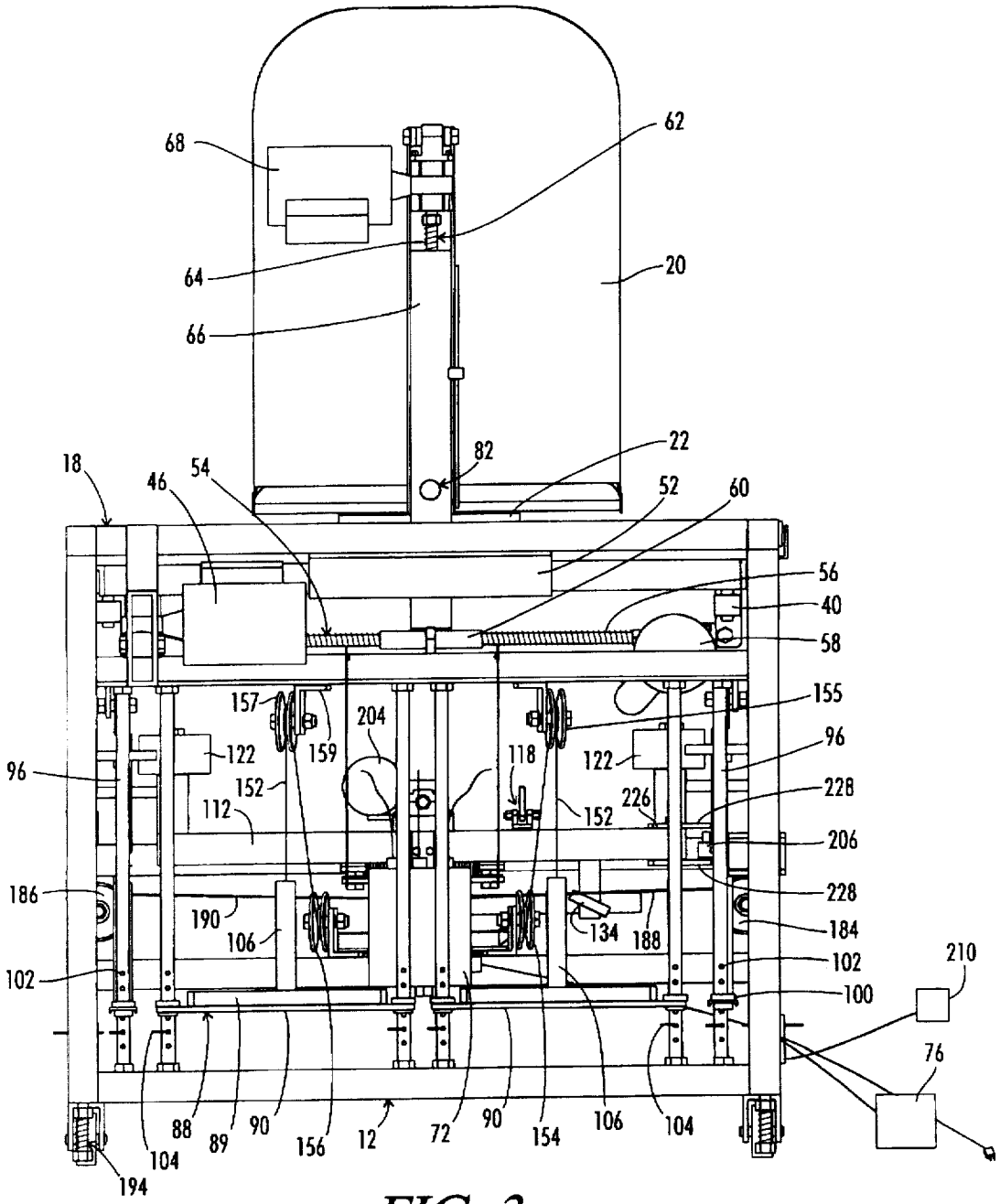
FIG. 3 is a rear elevational view of the embodiment of the invention shown in FIG. 1.

With reference to FIGS. 2 and 3, a third linear actuator 62 is mounted to the back of the seat 20 to control upward and downward adjustment of the seat 20. The actuator 62 includes a threaded shaft 64 operably attached to a third motor 68. The shaft 64 is received within an elongated sleeve 66 mounted to the back of the seat 20 and threadably engages a cooperatively threaded nut 70 (not shown) within the sleeve 66. The shaft 64 moves up and down inside the sleeve 66 in response to the rotational force of the motor 68.

With reference to FIGS. 2 and 4, the three motors 46, 58 and 68 are wired to a control box 72 mounted to the base frame 12. The control box 72 is wired to a power source 74 (not shown). In the preferred embodiment, a hand-held control unit 76 is provided for enabling remote adjustment of the seat 20. The remote control unit 76 includes an on/off switch 78 and a plurality of two-position toggle switches 80 for controlling the various directional movements of the seat 20. Accordingly, one of the toggle switches 80 controls forward and rear movement. A second toggle switch 80 controls side to side movement, and a third switch 80 controls up and down movement of the seat 20. The hand-held remote control unit 76 is wired to the control box 72.

In the preferred embodiment, the seat 20 swivels to enable a user to mount the apparatus 10 from either side of the base frame 12. A locking device 82 is provided to lock the seat 20 into a desired position (FIG. 2). The locking device 82 comprises a spring-loaded pin or bolt 84 which extends through a wall of the sleeve 66 and is received within a bore 86 in the pedestal 21. In the locked position, the pin 84 is biased into the bore 86 to prevent pivotal movement of the seat 20. The pin 84 may be retracted to release the seat 20.

With reference to FIGS. 1, 2 and 3, the apparatus 10 further includes a plurality of weight slides or weight stacks 88, each configured to receive at least one weight 89 to provide resistance during exercise. Each weight slide 88 comprises a longitudinal weight rest 90 having bores 92 and 94 at spaced apart ends of the weight rest 90 for receiving vertical guide rods 96. Bushings 100 may be provided at each of the bores 92 and 94 for enabling the longitudinal weight rest 90 to glide smoothly along the guide rods 96. In the preferred embodiment, each of the guide rods 96 includes a plurality of bores 102 configured to receive a pin 104 enabling the user to restrict the vertical travel of the longitudinal weight rest 90. The ends of each of the guide rods 96 are attached to the base frame 12. Each weight slide 88 further includes a cable having one end attached to each longitudinal weight rest 90 at a cable attachment rod 106 and an opposite end operably attached to a pulley system described hereinbelow.

Figure 5:
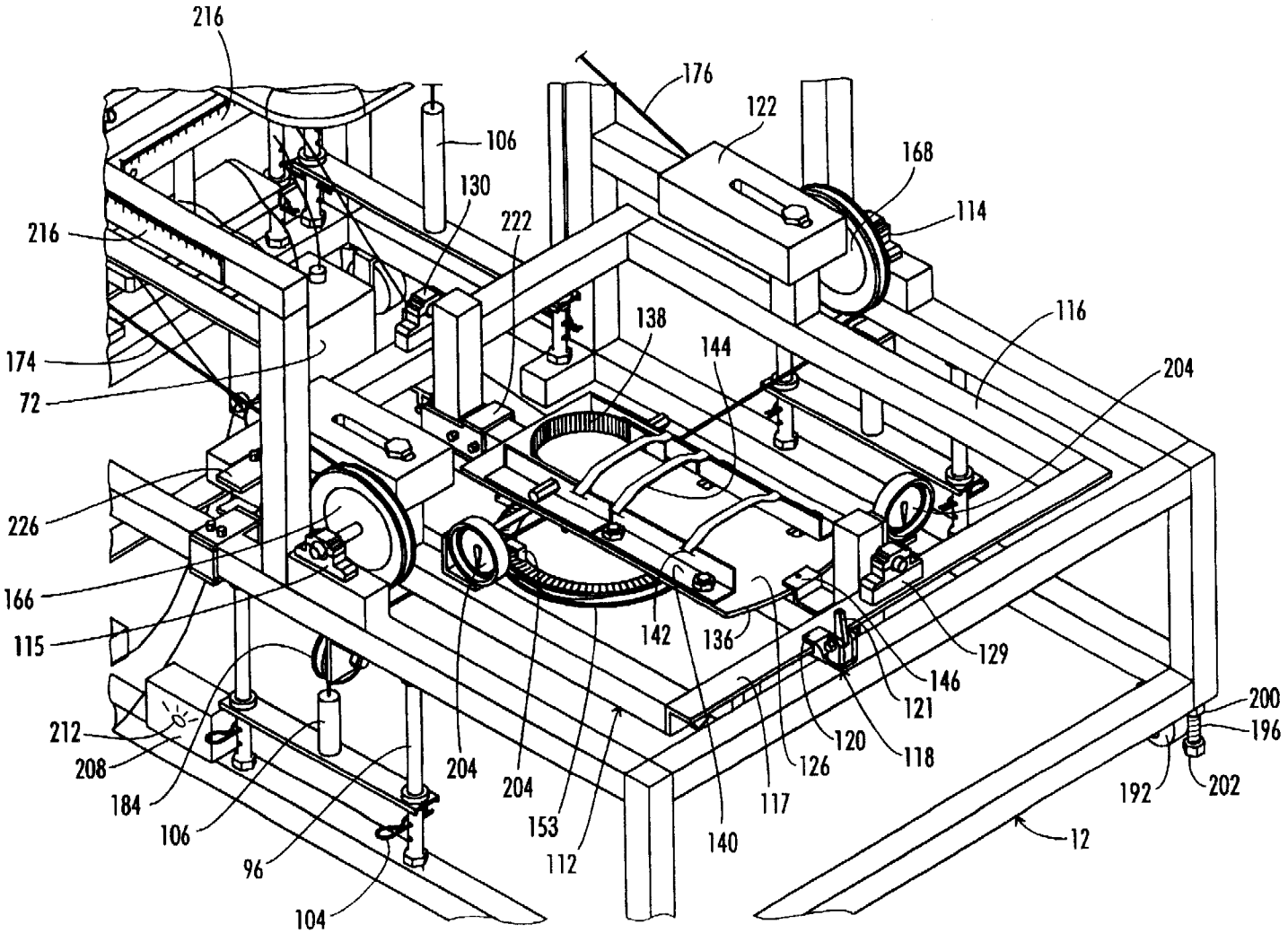
FIG. 5 is a partial elevated perspective view of the embodiment of the invention shown in FIG. 1.
Figure 7:
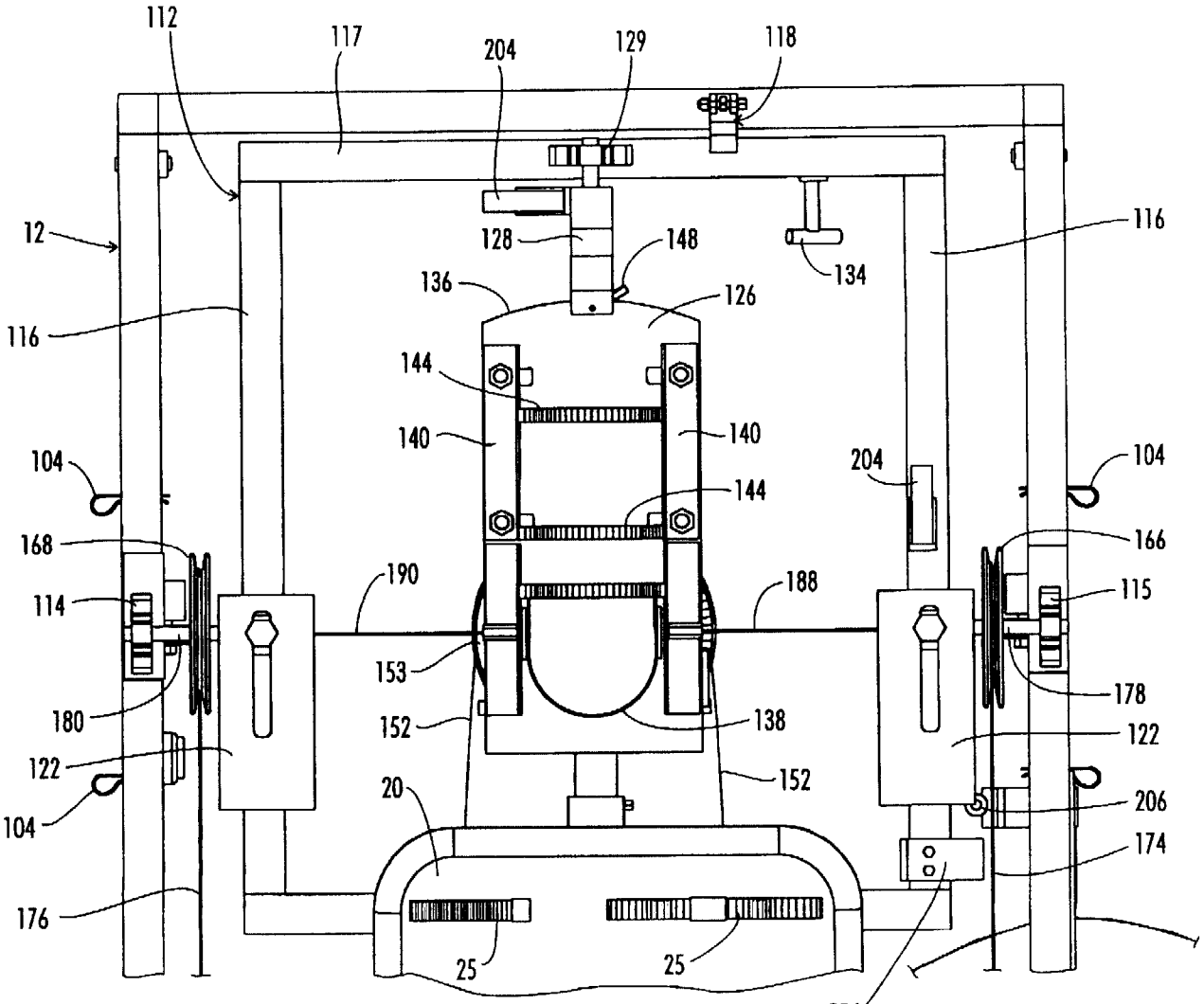
FIG. 7 is a partial top view of the embodiment of the invention shown in FIG. 1.
Figure 8:
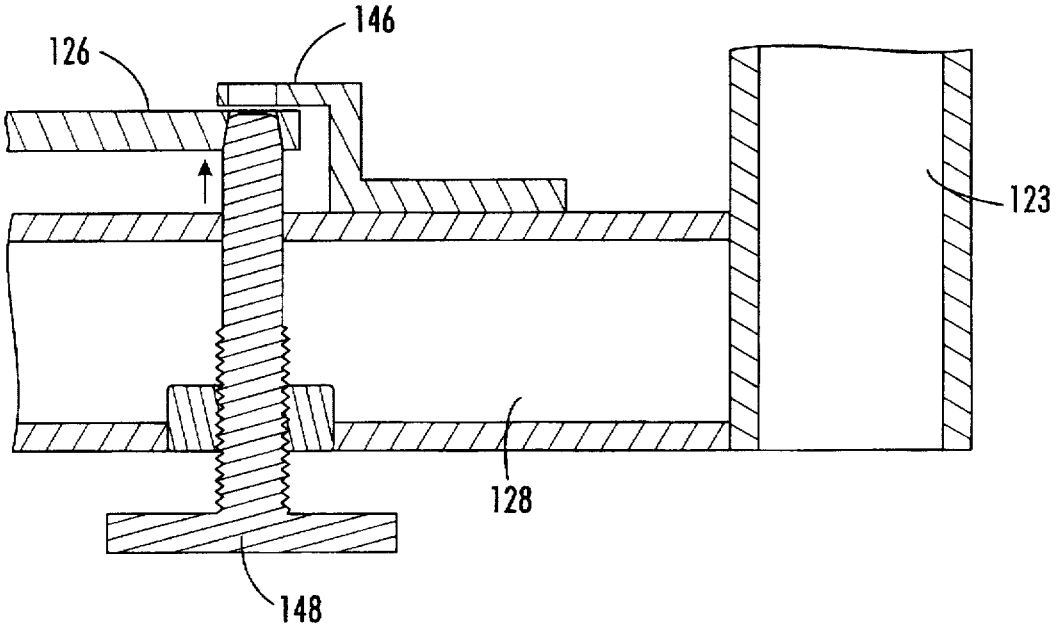
FIG. 8 is a partial side elevational view of the abduction/adduction locking device of the present invention.
Figure 9:
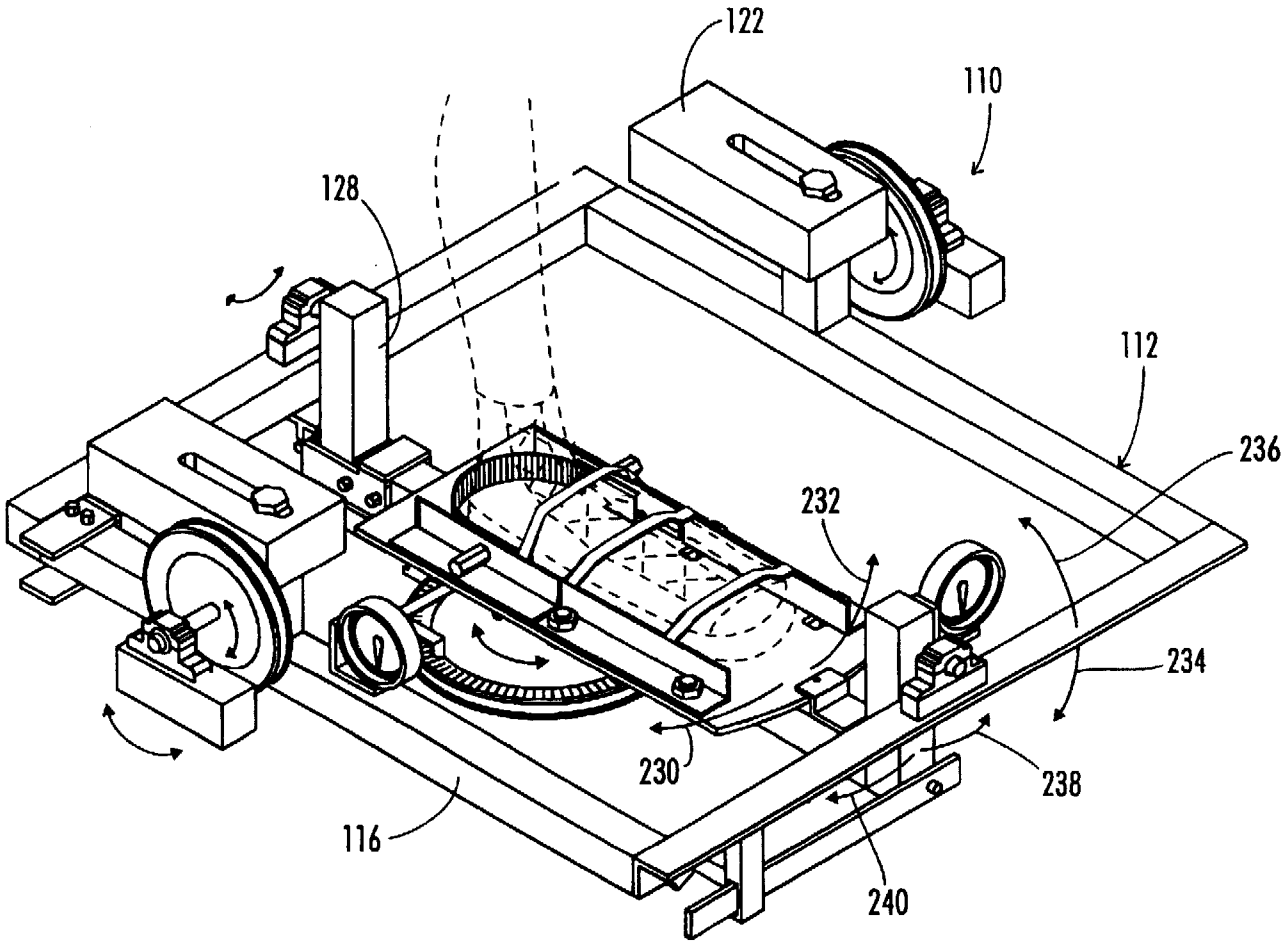
FIG. 9 is a partial elevated view of the foot carriage assembly showing the directional pivotal movement of the foot carriage frame during plantar and dorsiflexion of the foot, the directional pivotal movement of the support arm during inversion and eversion of the foot, and the directional pivotal movement of the foot platform during abduction and adduction of the foot.

With reference to FIGS. 4, 5 and 7, the present invention includes a foot carriage assembly 110 comprising a foot carriage frame 112 pivotally attached to the base frame 12 at bearings 114 and 115 for enabling plantar and dorsiflexion of the foot (see FIG. 9). Accordingly, the foot carriage frame 112 pivots upward and downward to achieve plantar and dorsiflexion of the foot, i.e., movement of the foot upward (standing on the heel) and downward (standing on the toes), respectively. In the preferred embodiment, the foot carriage frame 112 includes a pair of spaced apart side members 116 perpendicularly attached to a pair of crossmembers 117 to form a substantially square frame.

A locking device 118 comprising a clamp 120 and a handle 121 is mounted to the base frame 12. The clamp 120 is configured to receive an edge of the foot carriage frame 112 to prevent forward and backward movement thereof. A pair of counterweights 122 are mounted to the foot carriage frame 112 at either side to balance the frame 112.

The foot carriage assembly 110 further includes a foot plate assembly 124 comprising a platform 126 pivotally mounted on a U-shaped support arm 128. In the preferred embodiment, the free ends of the upwardly extending legs of the support arm 128 are pivotally attached to the crossmembers 117 of the foot carriage frame 112 at bearings 129 and 130. Accordingly, the support arm 128 pivots from side to side enabling inversion and eversion of the foot, i.e., movement of the sole of the foot toward and away from the midline, respectively. The platform 126 is positioned below the pivot point of the foot plate assembly 124 so that the pivot point of the foot plate assembly 124 is more closely aligned with the actual pivot point of the ankle when a foot is positioned on the platform 126.

A locking device 131, comprising an elongated rod 132 having one end attached to the support arm 128 and an opposite end received within a clamp 133, is mounted to the foot carriage frame 112. A T-screw 134 extends through a threaded bore 135 in the clamp 133 and bears against the rod 132 enabling the user to restrict side to side movement of the foot plate assembly 124.

The platform 126, which is substantially planar, includes an arcuate front edge 136, an adjustable heel bracket 138, and adjustable side brackets 140 for accommodating various foot or shoe sizes. The side brackets 140 may include slots 142 for receiving straps 144, such as nylon straps having hook and loop closures, for retaining the foot in position during exercise. The platform 126 pivots laterally through an arc to achieve abduction and adduction of the foot, i.e. movement of the foot away and toward the midline, respectively. The platform 126 rotates about a pivot point at a rear portion of the platform 126 which is substantially aligned with the actual pivot point of the foot at the ankle joint when the foot is positioned on the platform 126. An L-shaped flange 146 projecting upwardly from the support arm 128 forms a bracket for receiving the arcuate front edge 136 of the platform 126. A locking screw or bolt 148 extends through a bore 149 in the support arm 128 to frictionally engage a bottom surface of the platform 126 to prevent lateral rotation of the platform 126.

With reference to FIGS. 2, 3 and 4, a foot plate pulley system 150 includes a cable 152, a primary pulley wheel 153, a first pair of intermediate pulleys 154 and 155, and a second pair of intermediate pulleys 156 and 157. The pulley system 150 further comprises a central shaft 158 received within a bearing 160, the shaft 158 having one end operably attached to the foot platform 126 and an opposite end attached to the primary pulley wheel 153. The cable 152 is in operative communication with the primary pulley wheel 153, and the first pair (154 and 155) and the second pair (156 and 157) of intermediate pulleys, all of which are mounted to the base frame 12 with brackets 159. Each of the free ends of the cable 152 are attached to a weight slide 88 to provide resistance during abduction and adduction. In the preferred embodiment, intermediate pulleys 154 and 156 are mounted to the horizontal section 14 of the base frame 12, and intermediate pulleys 155 and 157 are mounted at the back of the vertical section 16 of the base frame 12. The cable 152 of the foot plate pulley system 150 is preferably connected to weight slides 88 mounted at a back of the vertical section 16 of the base frame 12. However, it is also contemplated that the cable 152 may be operably attached to any of the other weight slides 88 mounted to the base frame 12. A cable guide 162 is provided to retain the cable 152 in operative communication with the primary pulley wheel 153.

With reference to FIGS. 2 and 7, a side pulley system 164 comprises a pair of primary pulley wheels 166 and 168, a pair of intermediate pulleys 170 and 172, and a pair of cables 174 and 176 attached to weight slides 88 to provide resistance during plantar and dorsiflexion. Each of the primary pulley wheels 166 and 168 includes a central shaft 178 and 180, each having one end received within bearings 114 and 115 mounted to the base frame 12, and an opposite end operably attached to the foot carriage frame 112. One of the cables 174 is attached at one end to a pulley wheel 166, and to a weight slide 88 at the opposite end. In a similar fashion, cable 176 is attached at one end to primary pulley wheel 168 and to a weight slide 88 at the opposite end. Cable 174 communicates with intermediate pulley 170 intermediate its ends. Likewise, cable 176 communicates with intermediate pulley 172 intermediate its ends.

In the preferred embodiment, intermediate pulleys 170 and 172 are mounted to the vertical section 16 of the base frame 12 at opposite sides of the base frame 12. The cables 174 and 176 of the side pulley system 164 are preferably connected to weight slides 88 mounted at opposite back sides of the vertical section 16 of the base frame 12. However, it is also contemplated that the cables 174 and 176 may be operably attached to any of the other weight slides 88 mounted to the base frame 12.

Figure 6:
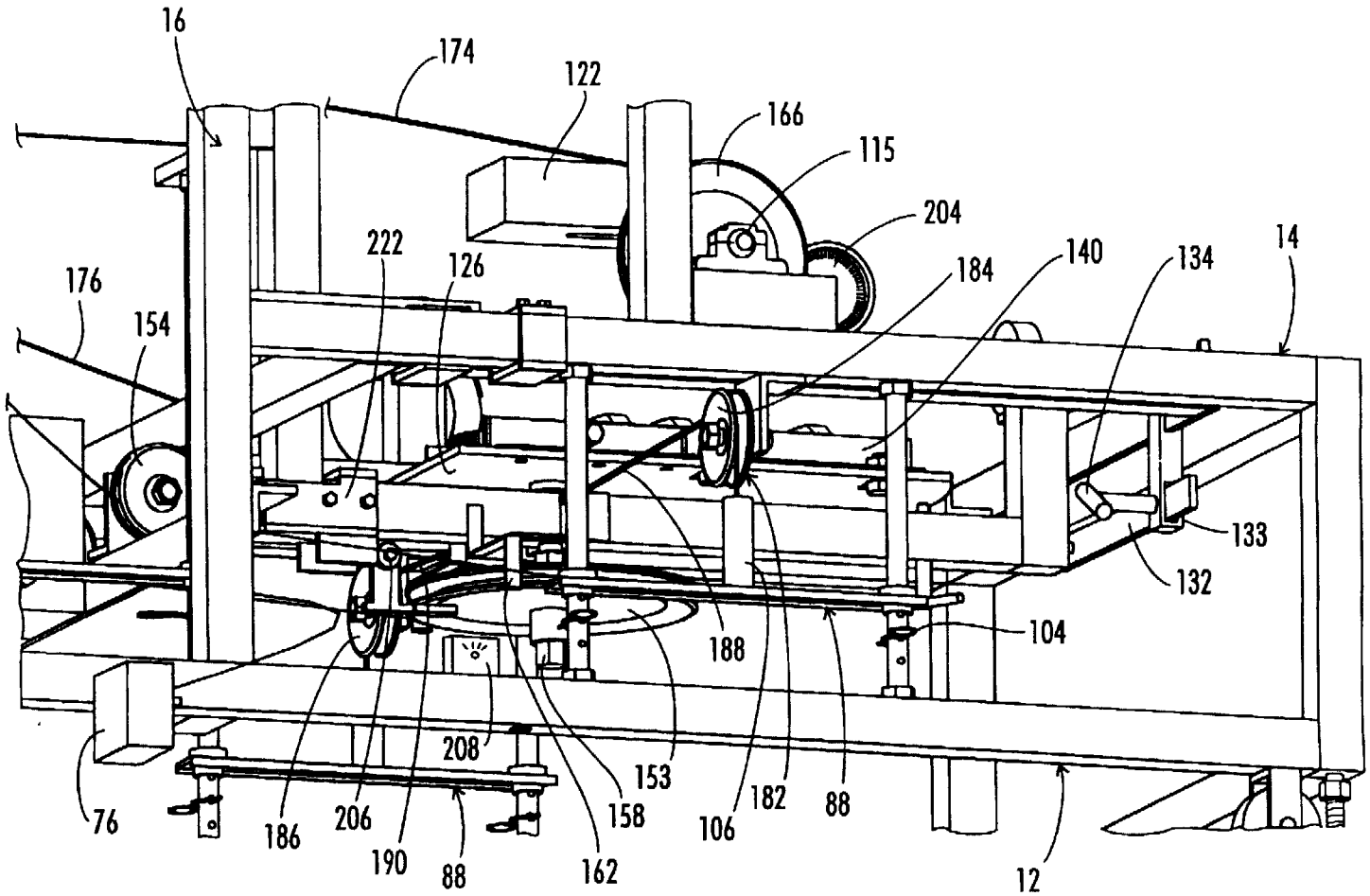
FIG. 6 is a partial side elevational view of the embodiment of the invention shown in FIG. 1.

With reference to FIGS. 4 and 6, a lateral pulley system 182, including a pair of pulley wheels 184 and 186 and a second pair of cables 188 and 190, provides resistance during inversion and eversion of the foot. Each of the cables 188 and 190, is attached at one end to the support arm 128 of the foot plate assembly 124 and to a weight slide 88 at the other end. The cables 188 and 190 are in operable communication with pulley wheels 184 and 186, respectively, intermediate their ends.

In the preferred embodiment, the base frame 12 includes casters or wheels 192 for mobilizing the apparatus 10. Leveling devices 194 are also provided at the corners of the base frame 12 to stabilize the apparatus 10. Each leveling device 194 preferably comprises a threaded rod 196 having one end received within a bore 198 in the base frame 12. A locking nut 200 is provided to retain the rod 196 at the desired position. A foot 202 is attached at the opposite end of the threaded rod 196. Accordingly, the feet 202 may be extended or retracted such that the apparatus 10 is raised off of the casters 192 and supported by the feet 202. In the preferred embodiment, bubble levels 204, or similar leveling devices, are mounted to the front, back and sides of the base frame 12 for enabling the user to level the apparatus 10 relative to a ground surface.

The apparatus 10 includes a plurality of gauges 204 mounted at appropriate locations to measure angular displacement. A first pitch angle gauge 204 mounted along a side member 116 of the foot carriage frame 112 measures angular displacement during plantar and dorsiflexion of the foot. A second gauge 204 mounted on the support arm 128 measures angular displacement during inversion and eversion of the foot. A third gauge 204 mounted to a top surface of the pulley wheel 153 of the foot plate pulley system 150 measures angular displacement during abduction and adduction of the foot.

The apparatus 10 further includes pressure sensors 206 operably mounted to the apparatus for measuring the amount of resistance applied during isometric (i.e., muscle contraction with no joint movement) exercise of the foot in six directions (plantar, dorsiflexion, inversion, eversion, abduction and adduction). The preferred embodiment of sensors includes the Model 561 Mini Load Cell manufactured and sold by AmSensors, Inc. of San Diego, Calif.

In the preferred embodiment, a first sensor 206 operably mounted at the foot carriage frame 112 and the support arm 128 measures resistance during isometric inversion and eversion. A second sensor 206 operably mounted at the pulley wheel 153 and the support arm 128 measures resistance during isometric abduction and adduction. A third sensor 206 operably mounted at the base frame 12 and the foot carriage frame 112 measures the amount of resistance during isometric plantar and dorsiflexion movement. The sensors 206 are wired to a control box 208 mounted to the base frame 12. The control box includes a four-position switch 212 for enabling the operator to energize the sensors 206 and to selectively obtain readings from any of the selected sensors 206. A remote control unit 210 having a readout display 214 is provided to indicate the amount of resistance (in pounds or kilograms, for example) applied by the patient.

In the preferred embodiment, a first boot 222, configured to operably engage the first and second sensors 206, is slidably received on the support arm 128. The boot 222 preferably includes a first pair of spaced apart flanges 224 extending laterally from an end of the boot 222 and a second pair of spaced apart flanges 226 extending perpendicularly from a bottom of the boot 222. The boot 222 may be slidably positioned along the support arm 128 such that a sensing head 207 of the first sensor 206 is operably received within the first pair of spaced apart flanges 224 of the boot 222. Alternatively, the boot 222 may be slidably positioned along the support arm 128 such that the sensing head 207 of the second sensor 206 is operably received within the second pair of spaced apart flanges 224 of the boot 222. A second boot 226, having a pair of spaced apart flanges 228 extending therefrom and configured to operably engage the third sensor 206, is slidably received on the foot carriage frame 112. The second boot 226 may be slidably positioned along the foot carriage frame 112 such that the sensing head 207 of the third sensor 206 is operably received within the spaced apart flanges of the second boot 226.

MODE OF OPERATION

In operation, the seat 20 is lowered to its lowermost position, adjusted to the right or left extreme and pivoted toward the right or left side, respectively, of the apparatus. A patient is seated on the apparatus 10 and secured thereto with the seatbelt 23 and leg straps 25. The seat 20 is then swiveled toward the front of the apparatus 10 to enable the patient to position his or her foot on the platform 126. Using the remote control unit 76, the seat 20 may be adjusted forward or backward, from side to side and up or down as required for the particular patient. Rulers 216 mounted horizontally at the front and side of the seat assembly support section 18 and vertically at a back of the seat 20 enable the operator to record the position suitable for a particular patient. A pointer 218 extending from the pedestal base plate 22 indicates a particular side-to-side position relative to ruler 216. Similarly, a pointer 218 extending from the side roller assembly 26 indicates a particular front/back position relative to ruler 216. An indicator or pointer 216 is also provided at the back of the seat 20 to indicate a particular vertical position. The foot may be secured to the platform 126 using the straps 144 attached to the side brackets 140.

For the purposes of illustration, the directional movements shown on FIG. 9 are designated by reference numerals as follows for movement of the right foot (shown in phantom): abduction 230, adduction 232, plantar 234, dorsiflexion 236, inversion 238 and eversion 240. However, as adduction and inversion describe movements toward the midline, and abduction and eversion describe movements away from the midline, it follows that the directions of movement for the left foot will be opposite those for the right foot. For example, the directional arrow indicating the direction of movement for abduction of the right foot indicates the direction of movement for adduction of the left foot. Similarly, the directional arrow indicating the direction of movement for inversion of the right foot indicates the direction of movement for eversion of the left foot. The directional arrows indicating the direction of movement for plantar and dorsiflexion are the same for both the right and the left foot.

Accordingly, in order to perform abduction 230 and adduction 232 of the right foot (see FIG. 9), locking device 118 is positioned to prevent upward and downward (i.e. plantar and dorsiflexion) pivotal movement of the foot carriage frame 112 and locking device 131 is positioned to prevent side to side (i.e. inversion and eversion) movement of the support arm 128 and platform 126. Locking bolt 148 is loosened to enable lateral pivotal movement of the platform 126. To retain the foot carriage frame 112 in a neutral position, a plurality of chains 220, each having one end attached to the base frame 12 and opposite end attached to one of the longitudinal weight rests 90, may be provided to remove the weight of the weight rests 90 from the cable 152 to which they are attached. The desired amount of weight is placed on the weight slides 88 associated with the foot plate pulley system 150. The weight positioned on the weight slides 88 provides resistance via cable 150. As the patient rotates the foot from side to side in an arc, the pulley wheel 153 rotates causing the longitudinal weight rests 90 to alternately move up and down in response to the lateral pivotal movement of the foot.

In order to perform plantar 234 and dorsiflexion 236 of the foot (FIG. 9), locking bolt 148 is tightened to restrict lateral pivotal movement of the platform 126 (i.e., abduction and adduction) and locking device 131 is positioned to prevent side to side movement of the support arm 128 and platform 126 (i.e., inversion and eversion). Locking device 118 is released. The desired amount of weight is placed on the weight slides 88 associated with the side pulley system 164. The weight positioned on the weight slides 88 provides resistance via cables 174 and 176. As the patient moves the foot forward and backward, primary pulley wheels 166 and 168 rotate on shafts 178 and 180, respectively, causing the longitudinal weight rests 90 to alternately move up and down in response to the movement of the foot.

In order to perform inversion 238 and eversion 240 of the right foot (FIG. 9), locking bolt 148 is positioned to restrict lateral pivotal movement of the platform 126 (i.e., abduction and adduction), and locking device 118 is positioned to prevent upward and downward movement of the foot carriage frame 112 (i.e., plantar and dorsiflexion). Chains 220 are operably attached to the base frame 12 and the longitudinal weight rests 90 to remove the weight of the weight rests 90 from the cable 152 to retain the foot carriage frame 112 in a neutral position. Locking device 130 is released. The desired amount of weight is placed on the weight slides 88 associated with the lateral pulley system 182. The weight positioned on the weight slides 88 provides resistance via cables 188 and 190. As the patient moves the foot from side to side, the longitudinal weight rests 90 move up and down in response to the lateral movement of the foot on the foot platform 126.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected by the appended claims.

What is claimed is:

1. An apparatus for exercising an ankle, comprising:

a base frame;

a seat mounted on the base frame;

a foot carriage assembly comprising a foot carriage frame pivotally attached at spaced apart sides to the base frame enabling plantar and dorsiflexion of the foot;

the foot carriage frame further including a foot plate assembly comprising a support arm pivotally attached at spaced apart ends to the foot carriage frame such that the support arm pivots about a longitudinal axis of the apparatus enabling inversion and eversion of the foot, and a foot platform pivotally attached to the support arm such that the platform pivots laterally about a pivot point at a rear portion of the platform enabling abduction and adduction of the foot; and a resistance system operably connected to the foot carriage assembly for providing resistance against a force applied by a person during use.

2. The apparatus of claim 1 wherein the resistance system comprises:

at least one weight stack including a longitudinal weight rest for supporting at least one weight, at least one guide rod attached to the base frame and extending through the longitudinal weight rest to enable the weight stack to maintain vertical alignment with the base frame during use; and a pulley system operably attached to the foot carriage assembly and the at least one weight stack to enable the at least one weight and the weight rest to be raised and lowered in response to movement of the foot carriage assembly.

3. The apparatus of claim 2 wherein the pulley system further comprises:

an abduction/adduction pulley system including a primary pulley wheel having a central shaft extending through the support arm and operably attached to the foot platform, first and second pairs of intermediate pulleys mounted to the base frame, and a cable in operable communication with the primary pulley wheel, the first and second pairs of intermediate pulleys and having free ends, each end being attached to a weight stack.

4. The apparatus of claim 2 wherein the pulley system further comprises:

a plantar/dorsiflexion pulley system including a pair of primary pulley wheels, each having a central shaft operably attached to the foot carriage frame, a pair of intermediate pulleys mounted to the base frame, and a pair of cables, each cable having one end in operable communication with one of the primary wheels and one of the intermediate pulley wheels and having an opposite end attached to a weight stack.

5. The apparatus of claim 2 wherein the pulley system further comprises:

an inversion/eversion pulley system including a pair of pulley wheels mounted to the base frame, and a pair of cables, each cable having one end attached to the support arm and an opposite end attached to a weight stack.

6. The apparatus of claim 2, wherein the guide rods further comprise:

a pin mechanism for adjusting the vertical travel of the longitudinal weight rest.

7. The apparatus of claim 1, further comprising:

a locking device for restricting movement of the foot carriage frame, the support arm and the foot platform.

8. The apparatus of claim 1 further comprising:

a seatbelt for securing a patient to the seat; and leg straps attached to the seat for restricting movement to the lower leg of the patient.

9. The apparatus of claim 1 wherein the foot platform further comprises:

an arcuate heel bracket; and adjustable side brackets for constraining the foot of a patient to the foot platform during use.

10. The apparatus of claim 1, further comprising:

at least one pitch angle gauge operably mounted to the apparatus for measuring an angular displacement of the foot carriage assembly during exercise of the patient's foot.

11. The apparatus of claim 1, further comprising:

at least one pressure sensor operably mounted to the apparatus for enabling the amount of force applied by the patient during exercise of the foot in a direction to be measured.

12. The apparatus of claim 1 further comprising:

a seat carriage assembly including a pair of side members perpendicularly attached to crossmembers to form a seat carriage frame.

the seat carriage frame further including a side roller assembly for enabling the forward and backward adjustment of the seat and a pair of sleeves configured to slidably receive the crossmembers for enabaling the side to side adjustment of the seat.

13. The apparatus of claim 12, further comprising:

at least one linear actuator operably linked to at least one motor and to the seat for adjusting the position of the seat.

14. The apparatus of claim 1 wherein the seat is pivotally mounted to the seat carriage assembly.

15. An apparatus for exercising an ankle, comprising:

a base frame;

a seat support section extending from the base frame;

a seat attached to the seat support section;

at least one weight slide including a longitudinal weight rest for supporting at least one weight and a cable attachment rod;

a foot carriage assembly comprising a foot carriage frame pivotally attached at spaced apart sides to the base frame, the foot carriage frame further including a foot plate assembly comprising a foot platform having brackets to constrain movement of the foot, wherein the platform is pivotally attached to the foot carriage frame via a support arm; and a complex pulley system in communication with and operably attached to the foot carriage assembly to enable the at least one weight slide to be raised and lowered in response to movement of the foot carriage assembly in any user selected direction.

16. The apparatus of claim 15 wherein the complex pulley system further comprises:

an abduction/adduction pulley system, a plantar/dorsiflexion pulley system and an inversion/eversion pulley system.

17. The apparatus of claim 16 wherein the abduction/adduction pulley system includes a primary pulley wheel having a central shaft extending through the support arm and operably attached to the foot platform, first and second pairs of intermediate pulleys mounted to the base frame, and a cable in operable communication with the primary pulley wheel, the first and second pairs of intermediate pulleys and having free ends, each end being attached to a weight slide.

18. The apparatus of claim 16 wherein the plantar/dorsiflexion pulley system includes a pair of primary pulley wheels, each having a central shaft operably attached to the foot carriage frame, a pair of intermediate pulleys mounted to the base frame, and a pair of cables, each cable having one end in operable communication with one of the primary wheels and one of the intermediate pulley wheels and having an opposite end attached to a weight slide.

19. The apparatus of claim 16 wherein the inversion/eversion pulley system includes a pair of pulley wheels mounted to the base frame, and a pair of cables, each cable having one end attached to the support arm and an opposite end attached to a weight slide.

20. The apparatus of claim 15 wherein the base frame further comprises:

a horizontal section and a vertical section.

21. The apparatus of claim 15 wherein the upright seat support section further comprises:

a seat carriage comprising a pair of side members perpendicularly attached to adjoining crossmembers.

22. The apparatus of claim 15, further comprising:

motorized linear actuator means for adjusting the position of the seat.

23. The apparatus of claim 22, wherein the motorized actuator means is electrically controlled by a central control box which actuates the motorized linear actuator means.

24. The apparatus of claim 23, further comprising:

a remote control unit configured to trigger the control box into actuating the motorized linear actuator means.

25. The apparatus of claim 15, further comprising:

a position indicator mounted to the apparatus displaying a user selected seat position.

26. The apparatus of claim 15, further comprising:

casters mounted to the base frame.

27. The apparatus of claim 15, further comprising:

leveling feet mounted to the base frame.

28. An apparatus for exercising an ankle, comprising:

a frame;

a seat mounted to the frame;

a carriage assembly comprising a carriage frame pivotally attached to the frame enabling plantar flexion and dorsiflexion of the foot, the carriage assembly further including a foot plate assembly pivotally attached the carriage frame enabling inversion and eversion of the foot, and a foot platform pivotally attached to the foot plate assembly enabling abduction and adduction of the foot; and a resistance system for providing resistance to a force applied by a person during plantar flexion, dorsiflxion, inversion, eversion, abduction and adduction of the foot.

29. The apparatus of claim 28, wherein the resistance system further comprises:

a foot plate pulley system for enabling abduction and adduction of the foot, the foot plate pulley system including a primary pulley wheel having a central shaft extending through the support arm and operably attached to the foot platform, first and second pairs of intermediate pulleys mounted to the base frame, and a cable in operable communication with the primary pulley wheel, the first and second pairs of intermediate pulleys and having free ends, each end being attached to a weight stack;

a side pulley system for enabling plantar and dorsiflexion of the foot, the side pulley system including a pair of primary pulley wheels, each having a central shaft operably attached to the foot carriage frame, a pair of intermediate pulleys mounted to the base frame, and a pair of cables, each cable having one end in operable communication with one of the primary wheels and one of the intermediate pulley wheels and having an opposite end attached to a weight stack; and a lateral pulley system for enabling inversion and eversion of the foot, the lateral pulley system including a pair of pulley wheels mounted to the base frame, and a pair of cables, each cable having one end attached to the support arm and an opposite end attached to a weight stack.

30. The apparatus of claim 28, wherein the foot plate assembly further comprises:

a support arm pivotally attached at spaced apart ends to crossmembers of the carriage frame, wherein the pivot axis of the support arm is aligned with the pivot axis of the person's ankle when the ankle is positioned on the foot plate.

31. The apparatus of claim 28, wherein the resistance system further comprises:

weight means operably connected to the carriage frame, the foot plate assembly and the foot platform.

* * * * *